US009102883B2

(12) United States Patent
Hanrott

(10) Patent No.: US 9,102,883 B2
(45) Date of Patent: Aug. 11, 2015

(54) SLAG DISCHARGE FROM REACTOR FOR SYNTHESIS GAS PRODUCTION

(75) Inventor: Christoph Hanrott, Muenster (DE)

(73) Assignee: ThyssenKrupp Uhde GmbH, Dortmund (DE)

( * ) Notice: Subject to any disclaimer, the term of this patent is extended or adjusted under 35 U.S.C. 154(b) by 999 days.

(21) Appl. No.: 12/737,578

(22) PCT Filed: Jul. 21, 2009

(86) PCT No.: PCT/EP2009/005295

§ 371 (c)(1),
(2), (4) Date: Jan. 26, 2011

(87) PCT Pub. No.: WO2010/012404

PCT Pub. Date: Feb. 4, 2010

(65) Prior Publication Data

US 2011/0154736 A1 Jun. 30, 2011

(30) Foreign Application Priority Data

Jul. 29, 2008 (DE) ..... 10 2008 035 386

(51) Int. Cl.
*C10J 3/52* (2006.01)

(52) U.S. Cl.
CPC .. *C10J 3/52* (2013.01); *C10J 3/526* (2013.01); *C10J 2300/1628* (2013.01)

(58) Field of Classification Search
CPC ..... C10J 3/52; C10J 3/46; C10J 2300/1625
USPC ..... 48/197 R
See application file for complete search history.

(56) References Cited

U.S. PATENT DOCUMENTS

| | | | |
|---|---|---|---|
| 4,465,496 | A | 8/1984 | Suggitt |
| 4,474,584 | A | 10/1984 | Koog |
| 4,487,611 | A | 12/1984 | Ziegler |
| 4,533,363 | A | 8/1985 | Jahnke et al. |
| 4,541,840 | A | 9/1985 | Hibbel et al. |

(Continued)

FOREIGN PATENT DOCUMENTS

| | | |
|---|---|---|
| CH | 661 054 | 6/1987 |
| DE | 1 030 624 | 1/1957 |

(Continued)

OTHER PUBLICATIONS

International Search Report.

*Primary Examiner* — Matthew Merkling
(74) *Attorney, Agent, or Firm* — Collard & Roe, P.C.

(57) ABSTRACT

With a method for discharging slag from a water bath of a reactor for synthesis gas production, whereby the slag is brought to a lower pressure level by means of a transfer container, a solution is supposed to be created, with which the components connected with transferring the slag out are subject to a low temperature, whereby immediate slag transfer without water exchange is supposed to be made possible, with a minimal required cooling power. This is accomplished in that a cooling water stream is passed to the slag stream in the outlet region of the slag from the water bath of the gas generator or the pressurized container that surrounds it, in a region having a greater cross-section than the cross-section of the entry connector of another system part, such as, for example, the transfer container, in such a manner that temperature stratification in the outlet region is made possible.

8 Claims, 3 Drawing Sheets

(56) References Cited

U.S. PATENT DOCUMENTS

Figure 1:
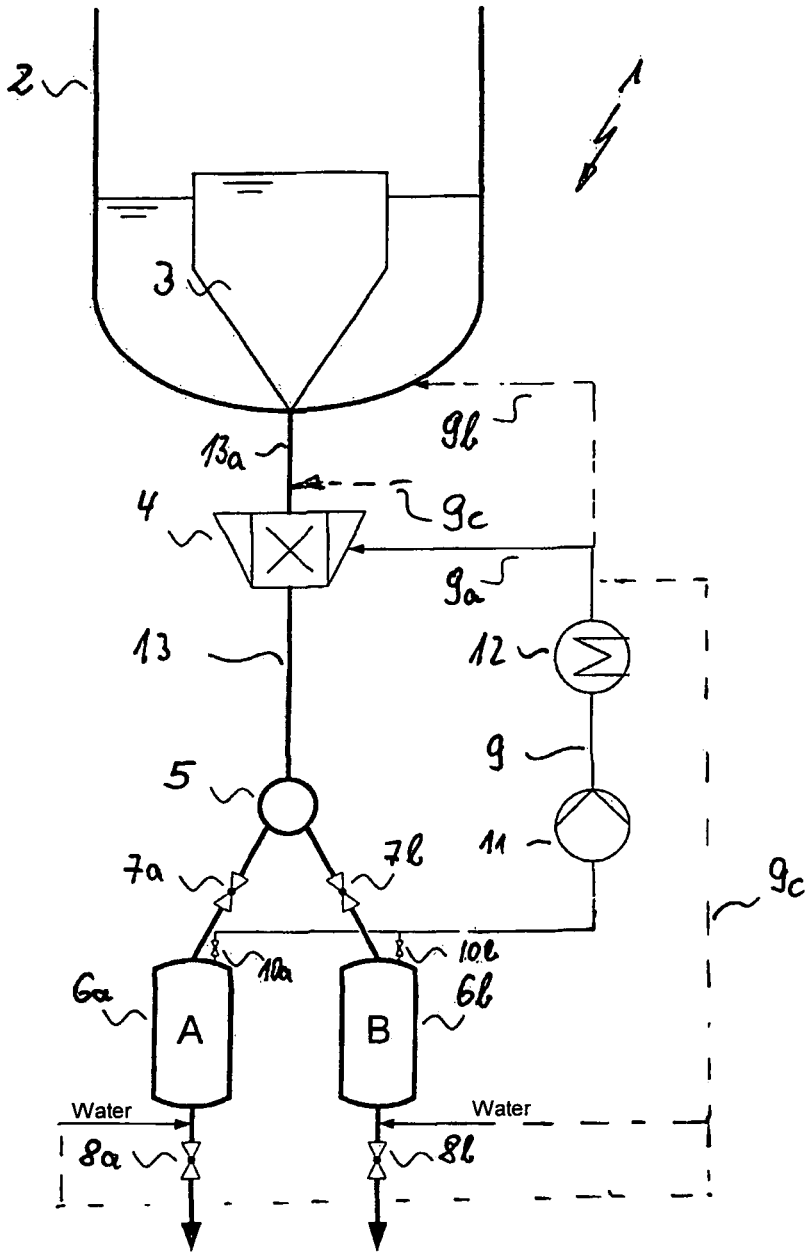

| | | | |
|---|---|---|---|
| 6,755,980 | B1 | 6/2004 | Van Den Born et al. |
| 7,621,972 | B2 | 11/2009 | Mehlhose et al. |
| 2010/0288711 | A1 | 11/2010 | Kowoll et al. |

FOREIGN PATENT DOCUMENTS

| | | |
|---|---|---|
| DE | 37 14 915 | 11/1988 |
| DE | 40 12 085 | 10/1991 |
| DE | 42 30 124 | 3/1994 |
| DE | 600 31 875 | 4/2007 |
| DE | 10 2006 040 077 | 3/2008 |
| EP | 0 101 005 | 2/1984 |
| EP | 0 290 087 | 11/1988 |
| EP | 0 452 653 | 10/1991 |
| EP | 0 586 837 | 3/1994 |
| EP | 1 097 984 | 5/2001 |
| WO | WO 2009/092569 | 7/2009 |
| WO | WO 2010/006746 | 1/2010 |

SLAG DISCHARGE FROM REACTOR FOR SYNTHESIS GAS PRODUCTION

CROSS REFERENCE TO RELATED APPLICATIONS

This application is the National Stage of PCT/EP2009/005295 filed on Jul. 21, 2009, which claims priority under 35 U.S.C. §119 of German Application No. 10 2008 035 386.8 filed on Jul. 29, 2008, the disclosure of which is incorporated by reference. The international application under PCT article 21(2) was not published in English.

The invention is directed at a method for discharging slag from a water bath of a reactor for synthesis gas production, whereby the slag is brought to a lower pressure level by means of a transfer container.

The slags that occur in the production of synthesis gas from fuels that contain carbon must be transferred out, as solids, from a water bath provided in such cases. In this regard, DE 600 31 875 T2 or DE 37 14 915 A1 are mentioned as examples, whereby the latter essentially corresponds to EP 0 290 087 A2.

For corresponding separation, particularly for thermal separation, corresponding shut-off organs are provided below the reactor, in the direction of gravity, ahead of the transfer container, and also below the transfer container, in the direction of gravity, in order to be able to open and close here, in cycles, in order to transfer the slag that occurs from the water bath of the reactor into the transfer container, in batches, and later out of this container.

U.S. Pat. No. 4,487,611 or DE 40 12 085 A1, which essentially corresponds to EP 0 452 653, describe that the temperature in the water bath should be as high as possible, in order to be able to utilize the latent or palpable heat there and in order to avoid an overly high demand for cooling water, whereby the temperature of the water bath should not lie above the evaporation temperature of the water at the corresponding pressures.

The known method of procedure demonstrates a number of disadvantages, since cooling takes place only in the transfer container or only before the transfer process, so that all the components of the slag/transfer system, including any slag breakers, valves, pipelines, and the like that might be present, are subjected to greater stresses as the result of the correspondingly higher temperatures. This means great demands on the materials used, whereby the expansions in the region of the transfer container are particularly great, as the result of changes in temperature at every transfer. Furthermore, cooling in the transfer container or the water exchange only just before the slag is transferred out requires a greater demand for time, and this brings with it longer cycle times.

From U.S. Pat. No. 4,465,496 and EP 0 101 005 A2, it is known to introduce a water stream into the transfer container before transferring the slag out, in order to cool the slag and also cool or exchange the amount of water contained in the transfer container. In this way, the vapors that occur during relaxation of the transfer container are avoided or greatly reduced.

A disadvantage of these known methods consists in that a higher peak cooling power must be applied for cooling the slag container and the transfer container, since it must be ensured, as indicated above, that the temperature is <100° C. in the transfer container, that vapor formation is prevented, and this leads to corresponding supplements in the cooling power, for safety reasons, whereby, as has already been mentioned, cooling does not take place continuously, and the heated cooling water, which still has a temperature clearly below the temperature of the water bath, cannot be used for cooling the slag. For this reason, as well, a sizable amount of additional water is needed, since the cooling power can be introduced only by way of the additional water in the transfer container.

The task of the invention consists in that the components connected with transferring the slag out are subject to a low temperature, whereby immediate slag transfer without water exchange is supposed to be made possible, with a minimal required cooling power.

This task is accomplished, according to the invention, with a method of the type indicated initially, in that a cooling water stream is passed to the slag stream in the outlet region of the slag from the water bath of the gas generator or the pressurized container that surrounds it, in a region having a greater cross-section than the cross-section of the entry connector of another system part, such as, for example, the transfer container, in such a manner that temperature stratification in the outlet region is made possible.

A number of advantages are achieved with the invention, since immediate cooling of the slag stream takes place by means of the cooling water stream passed to the slag stream at a very early point in time, so that the components that then follow, such as pipelines, shut-off elements, the transfer container as a whole, and the like, have clearly lower temperatures applied to them, whereby it can be provided that the cooling water stream is passed to the slag stream just ahead of or in the region of a slag breaker.

In this way, it is possible to pass in the cooling water stream in a region having a comparatively large cross-section, in order to avoid bridge formation of the slag and in order to allow a temperature stratification, with a separation between the hot water bath and the cold transfer container, and to avoid unintentional cooling of hot water. In the invention, feed of the cold water takes place at a different location, at which stratification is no longer influenced by turbulences of the water bath.

In an embodiment of the invention, it is provided that the cooling water stream is undertaken by means of a ring gap or the like, between the pressurized container outlet and a narrowing in cross-section on the transfer container inlet.

With this method of procedure, optimal temperature stratification is achieved, since the cold water can be introduced uniformly and removal by suction only takes place at a sufficiently remote location. By means of removal of the water by suction, a forced flow, directed downward, forms, whereby the lowest possible flow speed is made possible for sufficient cooling of the slag, but at the same time, a forced downward flow is ensured. Examples for possible cross-section of the narrowing in cross-section lie at 0.5 to 2 m, preferably at 1 m, as the diameter dimension, in practice.

For this purpose, the invention also provides that the feed of the cooling water stream into the transport pipe of the slag stream takes place at a low flow velocity.

In a particular embodiment, the invention provides that the cooling water stream is used as a hydraulic transport means for the slag stream, to convey the slag, even counter to the direction of gravity, to at least one transfer container.

Again, a number of significant advantages are connected with this measure, since the transfer container can be set up next to the reactor, for example. This leads to lower construction heights, i.e. there are no restrictions as far as the container dimensions are concerned, in the design of the device for carrying away the slag; also, multiple transfer containers can be used, without problems, working either in cycles or by splitting up the corresponding slag stream. A particular advantage consists in that the expansion that comes from the gasifier can be absorbed by the horizontal feed line, for example.

At this point, it should be noted that of course, seen in and of itself, the transport of solids by means of hydraulics is known, for example from DE 10 30 624, to mention only one example.

As was already mentioned briefly above, the invention also provides that the cooling water stream is passed to the slag stream in a region having a greater cross-section than the cross-section of the entry connector of the transfer container.

If a return of the cooling water stream, ahead of the transfer container, in the direction of gravity, is present here, then the invention also provides that part of the returned cooling water stream is introduced in a lower region of the transfer container, preferably into the lower connector of the transfer container, in order to swirl up finer slag particles, for example, and thus to prevent possible blockages, bridge formations, or the like, during discharge of the slag, if necessary also in order to bring about further cooling of the slag.

In another embodiment of the invention, it is also provided that part of the cooling water stream is guided in the direction of the water bath, counter to the solids flow, in the outlet region of the reactor or the pressurized container that surrounds it, in such a manner that a water stream out of the water bath is prevented. In this way, it is guaranteed that heat is not additionally removed from the water bath, whereby the regulation can be arranged in such a manner that water exchange is prevented entirely.

If more than one transfer container is provided, then another embodiment of the invention consists in that the cooling water stream/slag stream is divided up into at least two transfer containers and/or passed to these alternately. By means of the alternate feed to different transfer containers, comparatively continuous removal of slag is possible, i.e. while one transfer container is being emptied, the other transfer container can be filled with slag again, etc.

The invention also provides a corresponding device for implementation of the method, which is characterized in that the slag cooling pipe is provided, oriented in the direction of gravity, at the outlet of the reactor, which pipe is provided with a ring space for gentle, ring-shaped feed of a cooling water stream. This measure allows maintaining temperature stratification, by means of the gentle feed of the cooling water stream.

The corresponding device can be characterized, according to the invention, also in that the slag guidance and cooling pipe has a cross-section of 0.5 to 2 m, preferably 1 m, in order to make the transport and flow speeds within the cooling distance uniform, and to produce temperature stratification, in connection with this.

As was already mentioned further above, these dimensions represent a particularly practical embodiment of the invention, without the invention being restricted to them. It is evident that existing system components can advantageously be used together with the invention, since usually, systems that draw water off from the transfer container and thus bring about the slag flow in the direction of the transfer container are already present. Here, therefore, only a heat exchanger, a pipe section having a wider cross-section, and a corresponding water injection are required, in order to achieve the desired goals. Since the cold water is introduced below the separation layer, according to the invention, only a very slight heat exchange occurs as a result. Therefore the cold water is heated up only by the hot slag. This method of procedure therefore allows an improvement in the degree of effectiveness and, at the same time, lower thermal stress on the system parts.

Further characteristics, details, and advantages of the invention are evident from the following description and using the drawing. This shows, in FIG. 1 a simplified fundamental circuit schematic of a transfer region, with the transfer container positioned below the reactor, in the direction of gravity, FIG. 2 in a similar representation as in FIG. 1, the embodiment with transfer containers standing next to the reactor, and in FIG. 3 a schematic, enlarged partial representation of the pressurized container outlet.

In the circuit designated in general as 1 in FIG. 1, a pressurized container 2 having a water bath 3 is shown, in simplified manner, whereby the slag drawn off from the water bath 3 is broken up in a slag breaker 4 and passed to a distributor 5 that passes the slag alternately to a transfer container A and a transfer container B, whereby the two transfer containers are designated with 6*a* and 6*b*. For removal of the slag, in cycles, from the transfer container, in each instance, valves 7*a* and 7*b*, respectively, are provided ahead of the transfer containers, and valves 8*a* and 8*b* are provided behind the transfer containers.

A cooling water return line, designated in general with 9, which removes cooling water from the transfer containers 6*a* and 6*b* by way of valves 10*a* and 10*b*, is essential for the invention, whereby the cooling water stream is conducted by way of a pump 11 and a heat exchanger 12, and is passed back to a line region 13*a* having a large cross-section, by way of the line section 9*a*, for example into the region of the slag breaker 4 and/or by way of the line section 9*c* ahead of the slag breaker 4. The line 13, which can also serve for additional hydraulic transport, if necessary, between slag breaker 4 and distributor 5, is dimensioned in such a way, in this connection, that the slag stream is correspondingly cooled by the cooling water that is fed in.

Another line is indicated in FIG. 1, with a broken line, to return cooling water into the lower region of the pressurized container 2. This line section is designated with 9*b*, whereby another return line, designated with 9*c*, can also be provided, in order to feed water into the lower region of the transfer container(s), for example into the lower connector of the transfer container, in each instance, in order to build up a counter-flow, if necessary, which can serve to swirl up sludge particles or the like.

Figure 2:
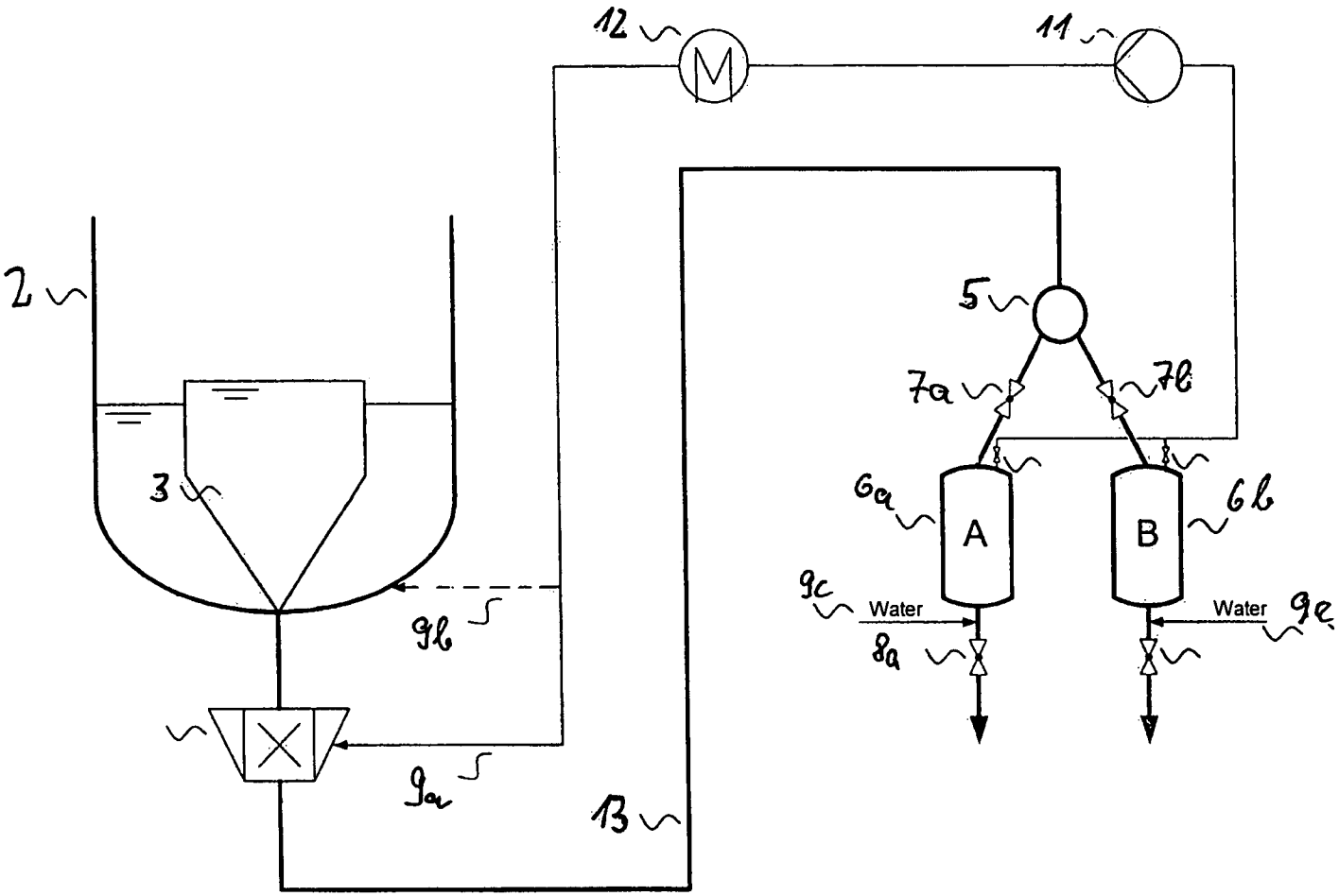

In the exemplary embodiment of FIG. 2, all the parts that are functionally equivalent are provided with the same reference symbols as in the description of FIG. 1, whereby a significant difference consists in that here, the two transfer containers 6*a* and 6*b* are not disposed below the pressurized container 2, in the direction of gravity, but rather next to it. Here, the line 13 is used as a hydraulic transport line. Setting up the two transfer containers 6*a* and 6*b* in a region next to the pressurized container 2 makes it possible that special structural measures or heat expansions have to be taken into consideration hardly or not at all. The construction height of the overall system can be significantly reduced.

Figure 3:
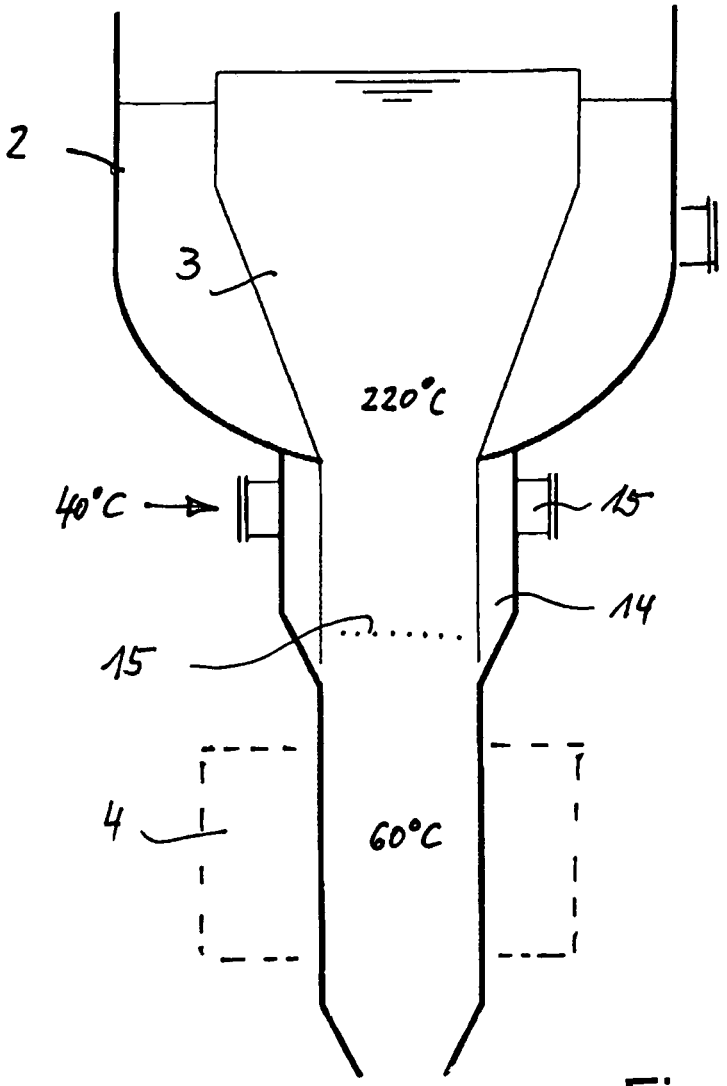

In FIG. 3, the outlet of the pressurized container 2 is shown schematically, whereby the water bath is lengthened in the funnel 3 in the outlet of the pressurized container 2, and surrounded by a ring channel 14 into which cooling water can be gently introduced by way of pipe connectors 15. The thermal separation layer is indicated with a dotted line and designated with 15. The temperatures that might prevail are indicated in FIG. 3 as an example, without the invention being restricted to these.

Of course, the exemplary embodiments of the invention as described can still be modified in many respects, without departing from the basic idea of the invention; in particular, even in the embodiment of FIG. 1, only one transfer container can be provided below the pressurized container 2, in the direction of gravity, in the exemplary embodiment of FIG. 1 and of FIG. 2, more than two transfer containers can be provided, if this might become necessary for reasons of process technology, and more of the same.

The invention claimed is:

1. A method for discharging slag from a water bath of a reactor for synthesis gas production, the method comprising steps of:

providing a reactor, said reactor comprising a water bath, a pressurized container surrounding the water bath, and a ring channel, wherein the pressurized container comprises an outlet for discharging a slag stream from the water bath, wherein the ring channel surrounds the outlet of the pressurized container;

providing a first transfer container, the first transfer container comprising an entry connector;

discharging a slag stream from the water bath through the outlet of the pressurized container;

passing a cooling water stream into the ring channel and to the slag stream discharged from the water bath in a region of the outlet of the pressurized container in such a manner that temperature stratification in the region is made possible;

hydraulically conveying the slag into the first transfer container via the cooling water stream; and bringing the slag to a lower pressure level via the first transfer container;

wherein the entry connector of the first transfer container has a first cross-section;

wherein the region of the outlet of the pressurized container has a second cross-section greater than the first cross-section; and wherein the temperature of the slag is reduced by continuous hydraulic movement of the slag from the region of the outlet to the transfer container.

2. The method according to claim 1, wherein the cooling water stream hydraulically conveys the slag counter to the direction of gravity to the transfer container.

3. The method according to claim 1, wherein at least part of the cooling water stream that hydraulically conveys the slag into the transfer container is returned via a returned cooling water stream to the ring channel to form the cooling water stream, and wherein the returned cooling water stream is passed through a heat exchanger.

4. The method according to claim 3, wherein part of the returned cooling water stream is introduced into a lower region of the transfer container.

5. The method according to claim 1, wherein part of the cooling water stream is guided in the direction of the water bath, counter to the slag stream, in the region of the outlet of the pressurized container, in such a manner that a water stream out of the water bath is prevented.

6. The method according to claim 1, wherein the cooling water stream also hydraulically conveys the slag into a second transfer container.

7. A device for carrying out the method according to claim 1, the device comprising a reactor comprising a water bath, a pressurized container surrounding the water bath, and a slag cooling pipe comprising a ring channel, the pressurized container comprising an outlet for discharging a slag stream from the water bath, and the ring channel surrounding the outlet of the pressurized container, wherein the slag cooling pipe is oriented in the direction of gravity, at the pressurized container outlet for a gentle, ring-shaped feed of a cooling water stream.

8. The device according to claim 7, wherein the slag guidance and the cooling pipe has a cross-section of 0.5 to 2 m, to make the transport and flow speeds within a cooling distance uniform, and to produce temperature stratification.

* * * * *